US006309724B1

(12) United States Patent
Külper et al.

(10) Patent No.: US 6,309,724 B1
(45) Date of Patent: Oct. 30, 2001

(54) LASER LABELS AND THEIR USE

(75) Inventors: Klaus Külper, Pinneberg; Arne Koops, Hamburg, both of (DE)

(73) Assignee: Beiersdorf AG (DE)

( * ) Notice: Subject to any disclaimer, the term of this patent is extended or adjusted under 35 U.S.C. 154(b) by 0 days.

(21) Appl. No.: 09/173,278

(22) Filed: Oct. 15, 1998

(30) Foreign Application Priority Data

Oct. 24, 1997 (DE) ..... 197 46 998

(51) Int. Cl.[7] ..... G09F 3/02

(52) U.S. Cl. ..... 428/40.1; 283/60; 283/81; 283/101; 283/103; 283/105; 428/40.2; 428/204; 428/206; 428/207; 428/352; 428/423.1

(58) Field of Search ..... 428/40.1, 40.2, 428/423.1, 204, 352, 207, 206; 283/81, 60, 101, 103, 105

(56) References Cited

U.S. PATENT DOCUMENTS 5,626,966 * 5/1997 Kulper ..... 428/423.1
5,824,397 * 10/1998 Koops ..... 428/207
5,843,547 12/1998 Külper, et al. ..... 428/40.1
5,914,165 * 6/1999 Freedman ..... 428/40.1

FOREIGN PATENT DOCUMENTS 44 05612 8/1995 (DE) .
195 09 505 1/1996 (DE) .
196 42 040 1/1998 (DE) .

OTHER PUBLICATIONS

Abstract of Dex 196 42 040, Jan. 15, 1998.

Abstract of Dex 44 05 612, Aug. 24, 1995.

* cited by examiner

*Primary Examiner*—Nasser Ahmad

(57) ABSTRACT

Laser label comprising at least one polymer layer which is coated on one side with a self-adhesive composition, which is in turn optionally covered with a release paper or a release film, characterized in that an additive suitable for optical, magnetic or electrical labelling has been incorporated into the polymer.

31 Claims, No Drawings

LASER LABELS AND THEIR USE

Technical labels are employed in numerous sectors for high-grade applications—for instance, as model identification plates for vehicles, machines, electrical and electronic appliances, as control labels for process sequences, and as badges of guarantee and testing. In numerous instances these applications automatically entail the need for a greater or lesser degree of security against counterfeiting. This counterfeiting security applies primarily for the period of application and for the entire duration of use on the part to be labelled: removal or manipulation, if possible at all, should entail destruction or visible, irreversible alteration. In particularly sensitive fields of application there must be a security stage for the production of the labels as well: if the acquisition and marking of such labels were too easy, and if imitations were produced, unauthorized persons would be given the possibility of improperly trafficking in the articles concerned.

For the rational and variable production of high-grade labels, especially in technoindustrial applications, the laser marking of suitable base material is becoming increasingly more established. DE U81 30 861.2 describes a multilayer label in which a top layer differing in colour is removed by the laser beam and, as a result, the contrast in colour with the adjacent layer permits inscriptions of high quality and legibility. Such an inscription constitutes a type of gravure, but removes the possibilities for manipulation associated with traditional printing with inks. DE U81 30 861.2 entails the label film being rendered so brittle, by means of the raw materials employed and the production process, that it is impossible to remove the bonded labels from their substrate without destroying them.

An additional security stage is described in the single-layer laser label of DE U94 21 868: here, in addition to the advantageous properties of DE U81 30 861.2, the inscription is brought about not by gravure in the top layer but by a change in colour in the polymer layer itself, thereby very substantially preventing subsequent manipulation at the level of the inscriptions.

Consequently, the only potential missing link in the security chain is that such single-layer and multilayer labels are freely available for laser inscription—for goods of appropriately high value, therefore, the acquisition of the labels and their inscription, even with expensive laser equipment, might be regarded as possible and rewarding.

In order to close the chain, it was the aim of the development to configure the material from which the labels are made in such a way, for their subsequent inscription, that such material can be identified at any time, with little effort and no destruction, as authentic, original material. For the laser labels which have already been specified, subsequent identification, although possible in principle, is nevertheless bound up with unacceptable analytical effort and is destructive.

Diverse techniques of ensuring security against counterfeiting are known for particularly security-relevant products, such as bank notes, cheques, cheque cards and personal ID cards, inter alia. In addition to water marks, printing with intricate patterns, and application of holograms, "invisible" markings are also occasionally employed.

JP 08/328474 describes a textile clothing label which is printed on its top face with a transparent, fluorescent ink, it being intended for the woven design and the printed image to be approximately identical in overlap. A similar surface printing with UV-active, photochromic inks is described in WO 88/01288; in order to protect the chemicals, however, this ink layer requires an additional layer for protection against oxygen and water.

In FR 2734655, a security marking on cheques is achieved in that, in part, the printing under a layer which is permeable only to IR is invisible in the visible wavelength range but can be read/identified mechanically with special IR light.

EP 727316 achieves hidden security against counterfeiting by providing, in an extra layer, especially on paper, two reactive components which give a colour reaction under pressure—this reaction, however, is irreversible.

The use of electroconductive and/or magnetic inks for surface printing is described in JP 08/054825 and CN 1088239. For label applications on complex metal parts, such as vehicle and machine components, for example, the fitness of such systems for use is extremely limited.

The ink ribbons with fluorescent particles described in JP 07/164 760, which can be excited by IR, are transferred by means of heat, with thermal transfer printers. Although it is true that the prints constitute a hidden sign of originality, the printing is applied superficially and can be altered or removed with solvents, with heat or else mechanically.

DE 4231800 describes labels which for security against counterfeiting leave irremovable traces on the bonding substrates by means of sublimation inks or corrosive substances—in order to identify the traces, however, it is first necessary to remove the label, which is in many cases undesirable if not impossible.

For high security papers such as passports, shares, bank notes, etc., EP 453131 describes the incorporation into an interlayer between two permanently bonded plies of paper, along with the laminating adhesive, of fluorescent—especially UV-fluorescent—indicators which are detectable only on transmission of light of appropriate wavelength through the laminate, but not by reflection under incident light. This system is unsuited to applications where transmission of light through the bonded label is impossible, and for the totally opaque laser labels.

All of these methods are applied superficially or are effective superficially and are therefore useful only to an extremely limited extent if at all for the known laser labels, since in this case the surface of high optical quality and extreme resistance used, for example, for model identification plate applications would be altered and impaired. Such a modification would be particularly disruptive to the two-layer labels with high-gloss black top layer and white base layer that may be regarded as the technical standard for identification plates. In addition, the means of security against counterfeiting that are known from the prior art, which are applied superficially and subsequently, carry with them the potential for manipulation to be carried out mechanically or using heat, chemicals, etc.

The object of the present invention was therefore to incorporate a substantially "invisible" additional security stage into the material from which the labels are made in order that originality can be proved rapidly, nondestructively and with a minimum of effort. This invention has been realized by way of example for the laser-markable labels but can readily be transferred by the skilled worker to similar problem cases, such as printed labels, self-adhesive tapes and the like.

This object is achieved by a laser label as is characterized in more detail in the claims.

This facility proves to be both a technically favourable and an inexpensive solution, and has the advantage over the prior art that neither the high-value surface constitution of the top layer nor the top layer itself is altered; minor interventions are made only in the base layer. Consequently, neither the overall visual impression nor the top layer, which is critical for mechanical, chemical and physical resistance of the label, is altered. In addition, a customer-specific mark is easy to produce, thereby placing an additional hurdle in the way of the unauthorized acquisition and use of labels.

In the case of the two-layer and multilayer labels it is therefore possible to incorporate an appropriate additive into the base layer, which is the layer critical for the text. The top layer thereof therefore remains unchanged for, for example, the high-gloss identification plates; not until the laser engraving stage is the base layer partially exposed at the areas of the inscription. If the base layer—which in this case is white, for example—includes colour pigments, ink particles, coloured fibres and the like, then these coloured components become visible at the engraved areas. If different particles (different in colour, shape and/or size) are added in defined proportions to the formulation of the base layer and are homogeneously distributed therein, a distribution of this kind in the label base layer can serve as a "fingerprint" which can be produced and sold as a customer-specific product. The colour-imparting particles can be fine colour pigments or else, preferably, can be visible particles with a size in the order of 0.1–5 mm. When finely ground colour pigments are used, a slight shift in hue of the indicia is generated; with the visible particles, a characteristic mosaic of colour. When daylight-fluorescent inks are employed the "fingerprint" is perceptible without auxiliary means, something which is frequently unwanted. Preferably, therefore, use is made of colour pigments or particles which do not absorb in the region of visible light and hence in the normal case are invisible—only when the label is illuminated with a lamp of appropriate wavelength are the colour pigments excited to produce their characteristic luminescence. In addition to colour pigments excited by IR radiation, it is UV-active systems that are predominantly employed. Also suitable in principle are luminescent substances excited by electron beams, X-rays and the like, and also thermochromic pigments which change colour reversibly when the temperature is altered—in these cases, however, carrying out identification on the bonded label is in practice inconvenient and more complex than visualization using light of appropriate wavelength. When selecting the colour pigments it should be ensured that they are of adequate stability for the production of the labels (film production, adhesive coating) and do not undergo irreversible changes under the processing conditions (possibly thermal drying, electron-beam or UV curing, and the like). For long-term applications of the labels it is advantageous that these luminescent substances, which are sensitive in the majority of cases, are embedded in a polymer matrix and are additionally protected by the top layer. Further measures to counter mechanical abrasion and to protect against direct contact with oxygen and water are unnecessary.

A variety of pigments and dyes can be employed for the application of the invention. The most widespread are long-afterglow (phosphorescent) or fluorescent pigments, which are excited solely or predominantly by UV radiation and which emit in the visible region of the spectrum (for an overview see, for example, Ullmanns Enzyklopädie der technischen Chemie, 4th Edition, 1979, Verlag Chemie). IR-active luminescent pigments are also known. Examples of systems with UV fluorescence are xanthenes, coumarins, naphthalimides, etc., which in some cases are referred to in the literature under the generic term 'organic luminophores' or 'optical brighteners'. The addition of a few per cent of the luminescent substances concerned is sufficient, incorporation into a solid polymer matrix being particularly favourable in respect of luminosity and stability. Examples of formulations which can be employed are those with RAD-GLO® pigments from Radiant Color N.V., Netherlands, or Lumilux® CD pigments from Riedel-de Haën. Also suitable are inorganic luminescent substances; as long-afterglow substances, especially with emission of light in the yellow region, metal sulphides and metal oxides have been found favourable, mostly in conjunction with appropriate activators. These compounds are obtainable, for example, under the trade name Lumilux® N or, as luminescent pigments improved in terms of stability, luminosity and afterglow persistence, under the trade name LumiNova® from Nemoto, Japan.

These exemplary dyes/pigments are incorporated into the formulation of the base layer in amounts of 0.1–50%, preferably 1–25%, and are coated. After the final coating of the base layer with adhesive and, if appropriate, lining with release paper or release film, the material used for the labels is available for customer-specific use. After punching/laser cutting of the desired label geometries and following the final inscription by means of laser beam with text, barcodes, logos, etc., the label is present in its final form. When long-afterglow pigments, for example, are incorporated into the base layer, the label exhibits—following appropriate excitation of the luminescent pigments—a characteristic phosphorescence in the region of the laser inscription and at the edges, permitting its rapid and easy identification as an original label. Apart from the special light source and, if appropriate, a viewing shield to eliminate disruptive ambient light, no further expensive equipment is necessary—following the test, the label remains unaltered.

Labels of this kind whose base layer comprises luminescent substances, especially those which emit in the visible wavelength range only following UV or IR excitation, are also suitable for register-accurate manufacturing (printing, punching, application, etc.). Instead of separately applied printing or control marks, it is possible in the course of processing to utilize the light emission of the base layer for this purpose: in particular, following the inscription and cutting of the labels by laser beam from unpunched roll material, a downstream control unit is able, with suitable equipment, to use the excitation and emission at a defined area of the label as a control mark for further processing steps and/or for the production of the next label.

An alternative to the use of luminescent substances is the incorporation into the base layer of substances which can be detected magnetically or electrically. Changes in magnetic field, as in the case of alarm labels for articles of clothing, for example, although possible in principle, are not predestined for the fields of application (marking of machine components and automotive components predominantly made of metal). On the other hand it is appropriate, as a hidden security stage, to add to the base layer substances which render it electrically conductive. Using suitable measuring devices, which are transportable, easy to use and inexpensive to acquire, and using appropriate electrodes, it is possible to determine the conductivity of the base layer directly on the bonded label. The electrodes are attached at two different points A and B of the base layer and a voltage is applied. In the presence of unbroken electrical conductivity between A and B, a current flow is measured which can have a characteristic value depending on the nature and amount of the additive used. Since even when the label is used directly on metal the base layer is separated from the conductive metal by the electrically insulating layer of adhesive composition, there is no risk of erroneous measurements.

Counterfeiting by subsequent manipulation is ruled out in particular by virtue of the fact that the conductivity measurement can be made not only from edge to edge of the labels but also between arbitrary points exposed by laser treatment; so that conductivity can be detected in this case, the entire base layer must be of unbroken three-dimensional conductivity, something which can be ensured only as part of the original production process. A laser-inscribable label of this kind can be produced by adding electrically conductive substances to the formulation of the base layer; this can be done either in addition to the previous pigments or else as an at least partial replacement of the existing pigments, in order to retain the good processing properties of the coating pastes. Suitable conductive additives are, principally, electrically conductive metallic, organic, polymeric and inorganic substances, preference being given to the use of metals. Especially for white or light-coloured base layers, the intrinsic colour of the conductive additive must be borne in mind when making the selection. Conductive carbon black is likewise suitable, although only for black or other dark base layers.

In order to ensure good conductivity there should be a minimum limit concentration of additive so that sufficient particles are present in the base layer to have contact with one another. Below this limit concentration, a conductive path from A to B is no longer ensured in the three-dimensional microstructure of the base layer. Preference is therefore given to the use of metallic particles, with fibres of high length to cross-sectional ratio being preferred because, using such fibres, it is possible to ensure three-dimensional conductivity with lower concentrations than with spherical particles; in addition, the effect on the colour of the base layer is smaller with the fibres. On the bases of cost/benefit analyses, metals employed are preferably copper, iron, aluminium and steel and their alloys, although expensive metals of high conductivity, such as silver and gold, are also suitable. The fibre dimensions are 0.1–50 mm (length) and 1–100 $\mu$m (cross-section), preference being given to the use of metal fibres having a diameter of 2–20 $\mu$m with a cross-section-to-length ratio of from about 1:100 to 1:1000. Fibres of this kind are incorporated homogeneously into the known formulation at levels of 0.5–25%, preferably 2–10%, and are coated and cured in accordance with DE 81 30 861.2. After adhesive coating and lining with release paper, the label material available can be inscribed by a laser beam. Removing the upper, top layer exposes the indicia of the base layer in the region of the laser marking—when a voltage is applied via suitable electrode contacts to two different points A and B of these indicia, a conductivity is measured which is characteristic for the base layer and is determined, inter alia, by the nature and amount of the conductive additive. It is thereby possible to produce customer-specific labelled material by way of defined formulations.

Both of the alternatives given for modifying the base layer of a two-layer or multilayer label in order to incorporate additional security against counterfeiting into the material from which the labels are made can also be employed in modified form for a single-layer label, although in that case the advantages of the invention are in some cases not fully realized.

EXAMPLE A

As described exhaustively in DE U81 30 861.2, a two-layer laser label in accordance with the patent consists, for example, of a thin black top layer and a thick white base layer. The basic formulation for the respective coating paste consists of 90% of a commercially customary aliphatic polyurethane acrylate and 10% of hexanediol acrylate. The black paste is produced conventionally with carbon black and the white paste with titanium dioxide as colour pigment.

Black paste: 10% carbon black, viscosity about 15 dPas.

White paste: 20% titanium dioxide,

10% Lumilux® ROT [RED] CD 105 FF pigment from Riedel de Haën, plus 10% reactive diluent to establish a suitable processing viscosity.

The black paste is spread uniformly at 13 g/m$^2$ onto a high-gloss biaxially oriented polyester film of 50 $\mu$m and is initially crosslinked with electron beams [4 kGy]; after applying the white base to the black top layer at 100 g/m$^2$, complete through-crosslinking takes place at 80 kGy. Coating with a polyacrylate pressure-sensitive adhesive composition at 25 g/m$^2$ and lining with a commercially customary silicone paper give the label starting material for further, customer-specific uses.

After laser treatment of the two-layer label with logos, text, barcodes, etc., no change relative to the pre-treatment label can be seen under normal daylight conditions; only when the label is irradiated with a strong light source in the near UV range [wavelength maximum at about 360 nm] does the laser-treated text area become luminescent, and the edges of the label in the region of the white base layer become reddish violet. For clear recognition it is useful to have a shield in order to darken the label region by shielding out ambient light.

EXAMPLE B

Similar to Example A, but the long-afterglow pigment LumiNova® G 300 M from Nemoto, Japan, is incorporated at a level of 20% into the white paste instead of the luminescent substance Lumilux CD.

After appropriate darkening to remove ambient light, a characteristic yellow phosphorescence is obtained here firstly by means of a UV lamp as described in Example A but secondly also by means of a strong light source which emits in the visible wavelength range. In contrast to A, this luminescence does not disappear when the light source is switched off but instead remains visible for some minutes thereafter.

What is claimed is:

1. A laser label comprising at least one polymer layer, said polymer layer being coated on one side with a self-adhesive composition, said self-adhesive composition optionally being covered with a release paper or a release film, and said polymer layer comprising an additive incorporated into the polymer, wherein said additive is capable of undergoing a reversible luminescence or color which can be detected optically.

2. The laser label according to claim 1, wherein the additive undergoes said reversible luminescence or color when subjected to electron beams, X-rays, visible light, infrared light or ultraviolet radiation.

3. The laser label according to claim 2, wherein the additive undergoes said reversible luminescence or color when subjected to visible light.

4. The laser label according to claim 2, wherein the additive undergoes said reversible luminescence or color when subjected to infrared light.

5. The laser label according to claim 2, wherein the additive undergoes said reversible luminescence or color when subjected to ultraviolet radiation.

6. The laser label according to claim 1, wherein the additive comprises color pigments, ink particles and/or colored fibers.

7. The laser label according to claim 6, wherein the additive comprises color pigments having particle sizes of 0.1–5 mm.

8. The laser label according to claim 1, wherein the additive is arranged in the polymer layer in a pattern.

9. The laser label according to claim 8, wherin the pattern is that of a fingerprint.

10. The laser label according to claim 1, wherein the additive is present in the polymer layer in an amount of 0.1–50% by weight, based on the total weight of the polymer layer.

11. The laser label according to claim 10, wherein the additive is present in the polymer layer in an amount of 1–25% by weight, based on the total weight of the polymer layer.

12. The laser label according to claim 1, which further comprises a further additive which exhibits a color change when subjected to laser irradiation.

13. The laser label according to claim 1, which further comprises on a side of the polymer layer facing away from the self-adhesive composition a further polymer layer, said further polymer layer being partially removable by laser radiation.

14. The laser label according to claim 3, wherein said further polymer layer consists of an electron-beam-cured coating film having a thickness of 1–20 $\mu$m and having a color that contrasts with the color of the polymer layer.

15. A laser label comprising at least one polymer layer, said polymer layer being coated on one side with a self-adhesive composition, said self-adhesive composition optionally being covered with a release paper or a release film, and said polymer layer comprising an additive incorporated into the polymer, wherein said additive is capable of being detected magnetically.

16. The laser label according to claim 15, wherein the additive is arranged in the polymer layer in a pattern.

17. The laser label according to claim 16, wherein the pattern is that of a fingerprint.

18. The laser label according to claim 15, wherein the additive is present in the polymer layer in an amount of 0.1–50% by weight, based on the total weight of the polymer layer.

19. The laser label according to claim 18, wherein the additive is present in the polymer layer in an amount of 1–25% by weight, based on the total weight of the polymer layer.

20. The laser label according to claim 15, which further comprises a further additive which exhibits a color change when subjected to laser irradiation.

21. The laser label according to claim 15, which further comprises on a side of the polymer layer facing away from the self-adhesive composition a further polymer layer, said further polymer layer being partially removable by laser radiation.

22. The laser label according to claim 21, wherein said further polymer layer consists of an electron-beam-cured coating film having a thickness of 1–20 $\mu$m and having a color that contrasts with the color of the polymer layer.

23. A laser label comprising at least one polymer layer, said polymer layer being coated on one side with a self-adhesive composition, said self-adhesive composition optionally being covered with a release paper or a release film, and said polymer layer comprising an additive incorporated into the polymer, wherein said additive is capable of being detected electrically.

24. The laser label according to claim 23, wherein the additive is arranged in the polymer layer in a pattern.

25. The laser label according to claim 24, wherein the pattern is that of a fingerprint.

26. The laser label according to claim 23, wherein the additive is present in the polymer layer in an amount of 0.1–50% by weight, based on the total weight of the polymer layer.

27. The laser label according to claim 26, wherein the additive is present in the polymer layer in an amount of 1–25% by weight, based on the total weight of the polymer layer.

28. The laser label according to claim 23, which further comprises a further additive which exhibits a color reversal when subjected to laser irradiation.

29. The laser label according to claim 23, which further comprises on a side of the polymer layer facing away from the self-adhesive composition a further polymer layer, said further polymer layer being partially removable by laser radiation.

30. The laser label according to claim 29, wherein said further polymer layer consists of an electron-beam-cured coating film having a thickness of 1–20 $\mu$m and having a color that contrasts with the color of the polymer layer.

31. A method of proving the originality of a laser label, said method comprising providing a laser label according to any one of claims 11–30, and detecting the additive to provide proof of the originality of the laser label.

* * * * *